US012773644B2

(12) United States Patent
Ohshima

(10) Patent No.: US 12,773,644 B2
(45) Date of Patent: Oct. 27, 2026

(54) SCISSORS STRUCTURE

(71) Applicant: NATURE ARCHITECTS INC., Tokyo (JP)

(72) Inventor: Taisuke Ohshima, Tokyo (JP)

(73) Assignee: NATURE ARCHITECTS INC., Tokyo (JP)

( * ) Notice: Subject to any disclaimer, the term of this patent is extended or adjusted under 35 U.S.C. 154(b) by 212 days.

(21) Appl. No.: 18/834,291

(22) PCT Filed: Feb. 10, 2022

(86) PCT No.: PCT/JP2022/005315
§ 371 (c)(1),
(2) Date: Jul. 30, 2024

(87) PCT Pub. No.: WO2023/152866
PCT Pub. Date: Aug. 17, 2023

(65) Prior Publication Data
US 2025/0153064 A1 May 15, 2025

(51) Int. Cl.
*A63H 33/00* (2006.01)
*E04B 1/19* (2006.01)

(52) U.S. Cl.
CPC ..... *A63H 33/00* (2013.01)

(58) Field of Classification Search
CPC ..... A63H 33/00; E04B 1/343; E04B 1/19
See application file for complete search history.

(56) References Cited

U.S. PATENT DOCUMENTS 250,205 A * 11/1881 Collins ..... B65D 7/26 52/109
2,697,845 A * 12/1954 Broner ..... E01D 15/124 52/109
3,375,624 A * 4/1968 Mikulin ..... E04C 3/005 52/109
3,877,544 A * 4/1975 McCollum ..... B66F 11/044 182/69.5
5,038,532 A * 8/1991 Shahinpoor ..... E04B 1/3441 52/109
9,840,837 B1 * 12/2017 Matsuoka ..... E04B 1/19
2003/0040791 A1 2/2003 Oktay
2018/0051458 A1 * 2/2018 Matsuoka ..... E04H 15/50
2021/0162586 A1 6/2021 Zhang et al.

FOREIGN PATENT DOCUMENTS

JP 2002-318416 A 10/2002
JP 2019-023489 A 2/2019
JP 2021-535328 A 12/2021
KR 20160129699 A * 11/2016 ..... A63H 33/00
WO WO-2014115428 A1 * 7/2014 ..... A47B 23/007

OTHER PUBLICATIONS

Apr. 26, 2022 International Search Report issued in International Patent Application No. PCT/JP2022/005315.

* cited by examiner

*Primary Examiner* — Kimberly S Berona
(74) *Attorney, Agent, or Firm* — Oliff PLC

(57) ABSTRACT

A scissors structure includes a first arm member, a second arm member, and a first connecting member connecting a central portion of the first arm member and a central portion of the second arm member. The first and second arm members and the first connecting member are integrally molded, and the first connecting member is formed such that its torsional stiffness is low relative to its axial and bending stiffness.

4 Claims, 9 Drawing Sheets

SCISSORS STRUCTURE

TECHNICAL FIELD

The present disclosure relates to a scissors structure.

BACKGROUND

Conventionally, a magic hand mechanism is proposed. The magic hand mechanism includes first and second pillars (arms) arranged in a first row, third and fourth pillars arranged in the second row, a first pivot point (screw) connecting a central portion of the first pillar and a central portion of the third pillar in a relative rotatable manner, a second pivot point connecting a central portion of the second pillar and a central portion of the fourth pillar in a relative rotatable manner, a third pivot point connecting one end of the first pillar and one end of the fourth pillar in a relative rotatable manner, and a fourth pivot point connecting one end of the second pillar and one end of the third pillar in a relative rotatable manner (see Patent Document 1).

CITATION LIST

Patent Literature

PTL 1: JP2002-318416

SUMMARY

In the magic hand mechanism described above, each pillar (arm) and each pivot point (screw) are constructed using different materials, so that the number of parts required for assembly is increased. On the other hand, it is conceivable that each pillar and each pivot point are integrally molded in order to reduce the number of parts. However, it was not clear how to stably produce somewhat large deformation.

According to one aspect of the present disclosure, a scissors structure is provided. The scissors structure includes a first arm member, a second arm member, and a first connecting member connecting a central portion of the first arm member and a central portion of the second arm member. The first and second arm members and the first connecting member are integrally molded, and the first connecting member is formed such that its torsional stiffness is low relative to its axial and bending stiffness.

Other features and advantages of the present disclosure can be understood from following description and accompanying drawings, which are given illustratively and non-exhaustively.

DESCRIPTION OF EMBODIMENTS

The following describes some aspects of the disclosure with reference to embodiments.

Embodiment 1

Figure 1:
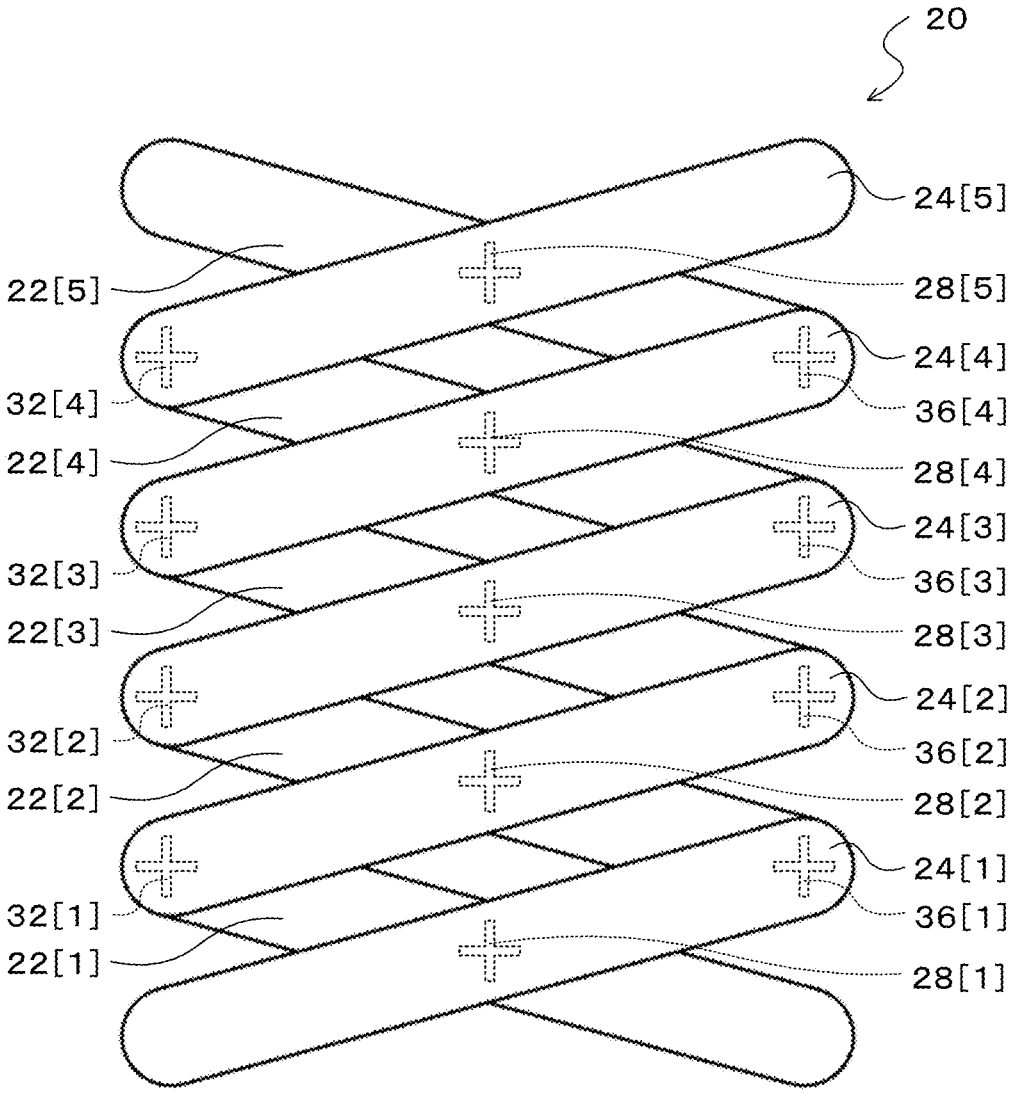
FIG. 1 is a top view of a scissors structure 20 as a first embodiment of the present disclosure.
Figure 2:
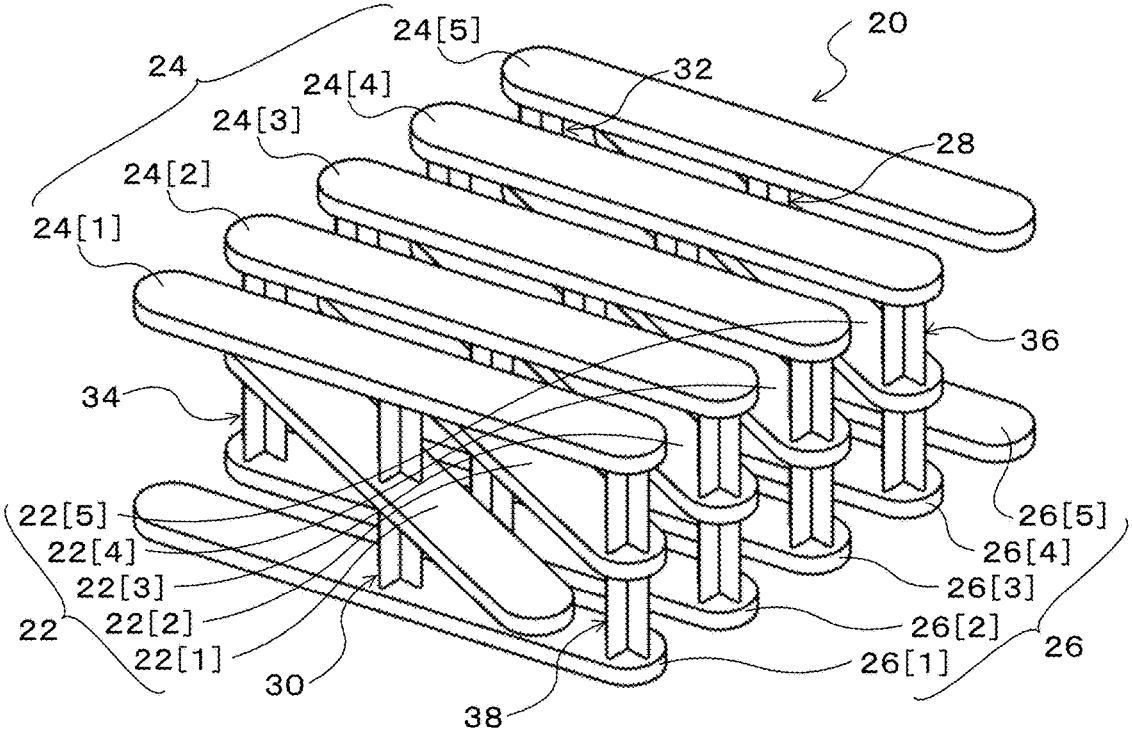
FIG. 2 is a perspective view of the scissors structure 20.
Figure 3:
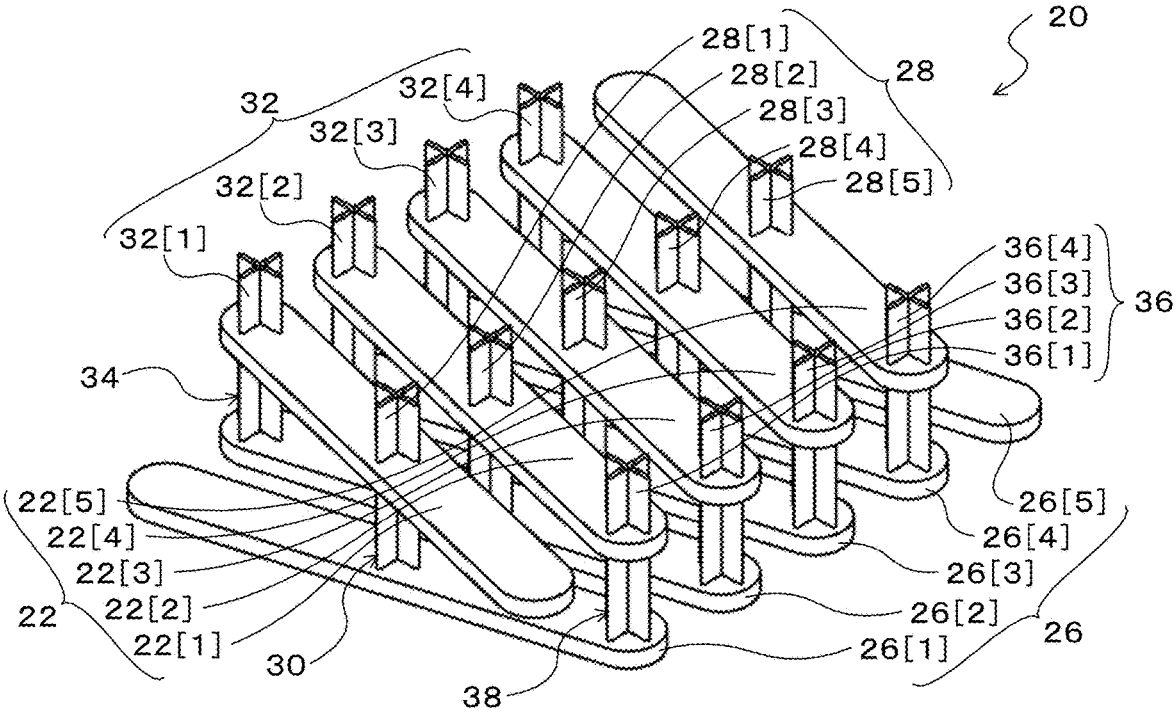
FIG. 3 is a diagram in which an arm member 24 is omitted from FIG. 2.
Figure 4:
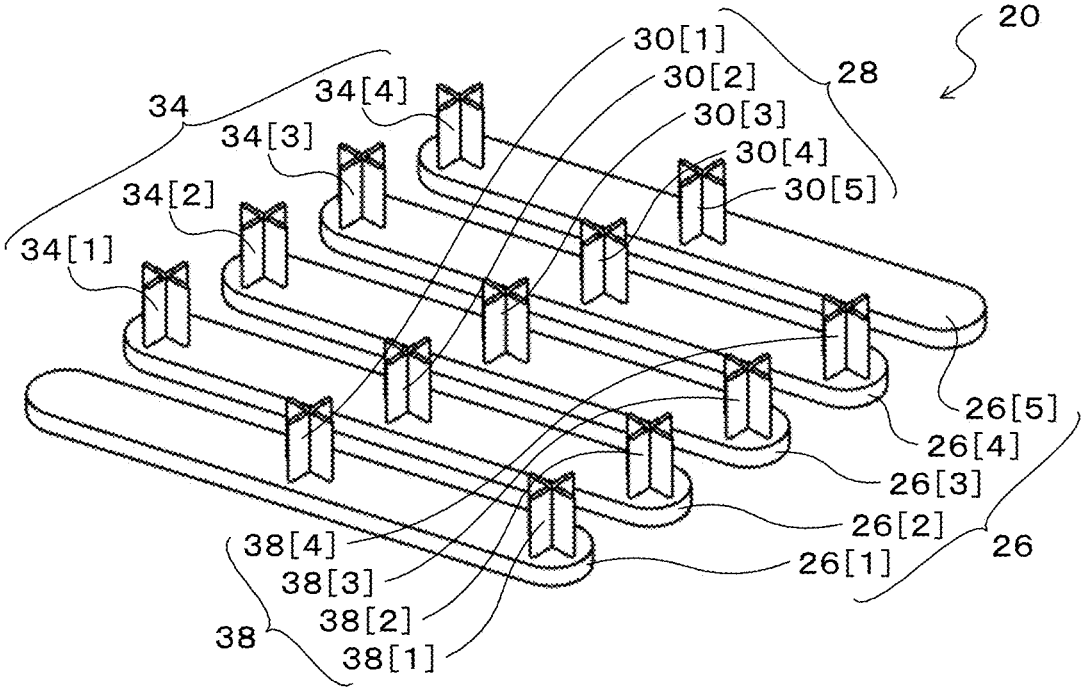
FIG. 4 is a diagram in which an arm member 22 and connecting members 28, 32 and 36 are omitted from FIG. 3.

FIG. 1 is a top view of a scissors structure 20 as a first embodiment of the present disclosure. FIG. 2 is a perspective view of the scissors structure 20. FIG. 3 is a diagram in which an arm member 24 is omitted from FIG. 2. FIG. 4 is a diagram in which an arm member 22 and connecting members 28, 32 and 36 are omitted from FIG. 3. The scissors structure 20 of the first embodiment is configured as an integrally molded member, for example, integrally molded by injection molding, blow molding, extrusion molding, or 3D printing of resin or rubber material, or integrally molded by casting, forging, pressing, cutting, extrusion molding, or 3D printing of metal material.

As shown in FIGS. 1 to 4, the scissors structure 20 includes five arm members 22 (22[1] to 22[5]), 24 (24[1] to 24[5]) and 26 (26[1] to 26[5]), respectively, five connecting members 28 (28[1] to 28[5]) and 30 (30[1] to 30[5]), respectively, and four connecting members 32 (32[1] to 32[4]), 34 (34[1] to 34[4]), 36 (36[1] to 36[4]) and 38 (38[1] to 38[4]), respectively. The numbers in [ ] are attached from bottom to top in FIG. 1 and from front to back in FIG. 2 to FIG. 4.

The five arm members 22[1] to 22[5] are each formed to extend in a straight line and are arranged at intervals in a first row (a row from left front to right back in the center in the upward-downward direction in FIG. 2 and FIG. 3). The five arm members 24[1] to 24[5] are each formed to extend in a straight line and are arranged at intervals in a second row (a row from the left front to the right back, above the first row in the upward-downward direction in FIG. 2). The five arm members 26[1] to 26[5] are each formed to extend in a straight line and are arranged at intervals in a third row (a row from the left front to the right back, lower than the first row in the upward-downward direction in FIG. 2 to FIG. 4). In the following, for the arm members 22[1] to 22[5], 24[1] to 24[5] and 26[1] to 26[5], the end on the left side in FIG. 1 and on the back side in FIG. 2 to FIG. 4 is referred to as "one end", and the end on the right side in FIG. 1 and on the front side in FIG. 2 to FIG. 4 is referred to as "the other end".

Each arm member 24[*i*] (i: 1 to 5) and each arm member 26[*i*] overlap each other in the upward-downward direction of FIG. 2. Each arm member 22[*i*] and each of the arm members 24[*i*] and 26[*i*] intersect each other in an X-shape in the upward-downward direction of FIG. 2. One end of each arm member 22[*j*] (j: 1 to 4) and one end of each of the arm members 24[*j*+1] and 26[*j*+1] overlap each other in the upward-downward direction of FIG. 2. The other end of each arm member 22[*j*+1] (j: 1 to 4) and the other end of each of the arm members 24[*j*] and 26[*j*] overlap each other in the upward-downward direction of FIG. 2.

Each connecting member 28[*i*] (i: 1 to 5) connects a central portion in the extending direction of the corresponding arm member 22[*i*] and a central portion in the extending direction of the corresponding arm member 24[*i*], and is cross-shaped in cross section and extends in a straight line, respectively. Each connecting member 30[*i*] connects a central portion in the extending direction of the corresponding arm member 22[*i*] and a central portion in the extending direction of the corresponding arm member 26[*i*], and is cross-shaped in cross section and extends in a straight line, respectively. Each connecting member 30[*i*] extends along the same axis as the corresponding connecting member 28[*i*], respectively.

Each connecting member 32[*j*] (j: 1 to 4) connects one end of the corresponding arm member 22[*j*] and one end of the corresponding arm member 24[*j*+1], and is cross-shaped in cross section and extends in a straight line respectively. Each connecting member 34[*j*] connects one end of the corresponding arm member 22[*j*] and one end of the corresponding arm member 26[*j*+1], and is cross-shaped in cross section and extends in a straight line respectively. Each connecting member 34[*j*] extends along the same axis as the corresponding connecting member 32[*j*].

Each connecting member 36[*j*] (j: 1 to 4) connects the other end of the corresponding arm member 24[*j*] and the other end of the corresponding arm member 22[*j*+1], and is cross-shaped in cross section and extends in a straight line respectively. Each connecting member 38[*j*] connects the other end of the corresponding arm member 26[*j*] and the other end of the corresponding arm member 22[*j*+1], and is cross-shaped in cross section and extends in a straight line respectively. Each connecting member 38[*j*] extends along the same axis as the corresponding connecting member 36[*j*], respectively.

Figure 5A:
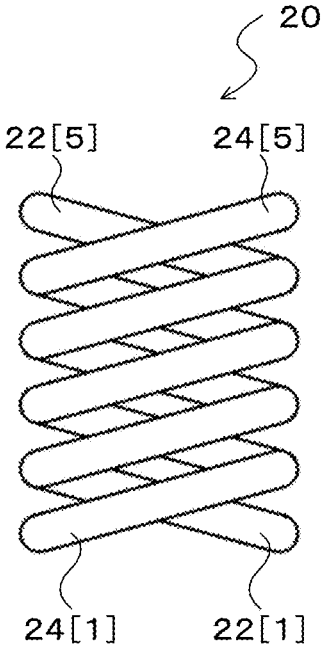
FIG. 5A is an illustration of deformation of the scissors structure 20.
Figure 5B:
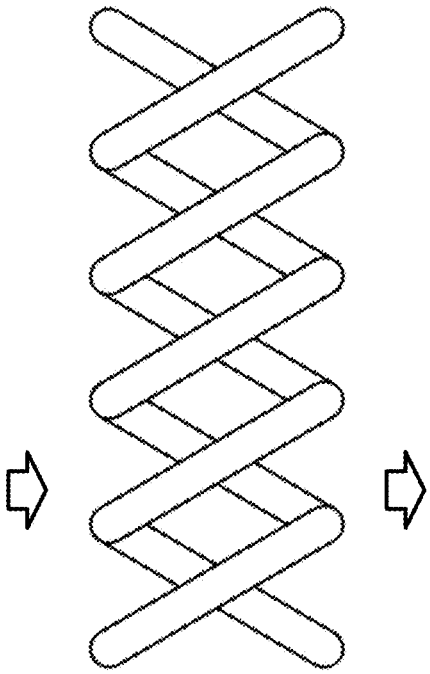
FIG. 5B is an illustration of deformation of the scissors structure 20.
Figure 5C:
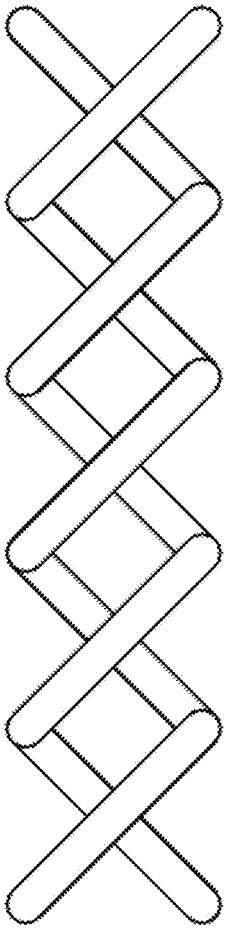
FIG. 5C is an illustration of deformation of the scissors structure 20.

In the first embodiment, the arm members 22, 24 and 26 and the connecting members 28, 30, 32, 34, 36 and 38 are integrally molded, and the cross section of each of the connecting members 28, 30, 32, 34, 36 and 38 is cross-shaped. Therefore, each of the connecting members 28, 30, 32, 34, 36 and 38 has low torsional stiffness relative to axial and bending stiffness, and has compliant mechanism characteristics which is easily deformed in the torsional direction and prevent deformation in other directions such as compression, tension and bending. Thus, the two corresponding arm members connected by each connecting member (e.g., the arm member 22[1] and the arm member 24[1] connected by the connecting member 28[1]) are easily (to somewhat large and stable) rotated around the connecting member. This enables a somewhat large deformation (change in length in the longitudinal direction) of the scissors structure 20 to be stably produced by applying a force to the scissors structure 20 to bring one end of the arm members 24[1] and 26[1] and the other end of the arm member 22[1] closer to each other, or by applying a force to increase the length in the overall longitudinal direction (left front to right back direction in FIG. 2). FIGS. 5A-5C illustrate deformation of the scissors structure 20. By applying a force to one end of the arm members 24[1] and 26[1] and the other end of the arm member 22[1] in the initial state of FIG. 5A to bring them closer to each other, and so on, the length of the scissors structure 20 in the longitudinal direction is increased as shown in FIG. 5B and FIG. 5C.

In the scissors structure 20 of the first embodiment described above, the arm members 22 (22[1] to 22[5]), 24 (24[1] to 24[5]) and 26 (26[1] to 26[5]) and the connecting members 28 (28[1] to 28[5]), 30 (30[1] to 30[5]), 32 (32[1] to 32[4]), 34 (34[1] to 34[4]), 36 (36[1] to 36[4]) and 38 (38[1] to 38[4]) are integrally molded, and each of the connecting members 28, 30, 32, 34, 36 and 38 is cross-shaped in cross section. This enables a reduction in the number of components. In addition, this enables a somewhat large deformation (change in length in the longitudinal direction) of the scissors structure 20 to be stably produced, because each of the connecting members 28, 30, 32, 34, 36 and 38 has the low torsional stiffness relative to the axial and bending stiffness. Furthermore, the scissors structure 20 of this embodiment has no gap between each component, unlike the configuration in which the arms and screws are assembled as in the above-mentioned background technology (see Patent Document 1). Therefore, the scissors structure 20 performs deformation operation more accurately because there is no rattling or asymmetry that may occur due to such gaps during the deformation operation.

The scissors structure 20 of the first embodiment includes the arm members 22, 24 and 26 and the connecting members 28, 30, 32, 34, 36 and 38. However, the configuration may be without the arm member 26 and the connecting members 30, 34 and 38 of the scissors structure 20 (hereinafter referred to as "scissors structure 20B"). The scissors structure 20B enables somewhat large deformation (change of length in the longitudinal direction) to be stably produced in the same manner as the scissors structure 20. It is assumed that the scissors structure 20B has the lower bending stiffness of the entire structure than the scissors structure 20, and is more likely to undergo a deformation other than the desired deformation.

Figure 11:
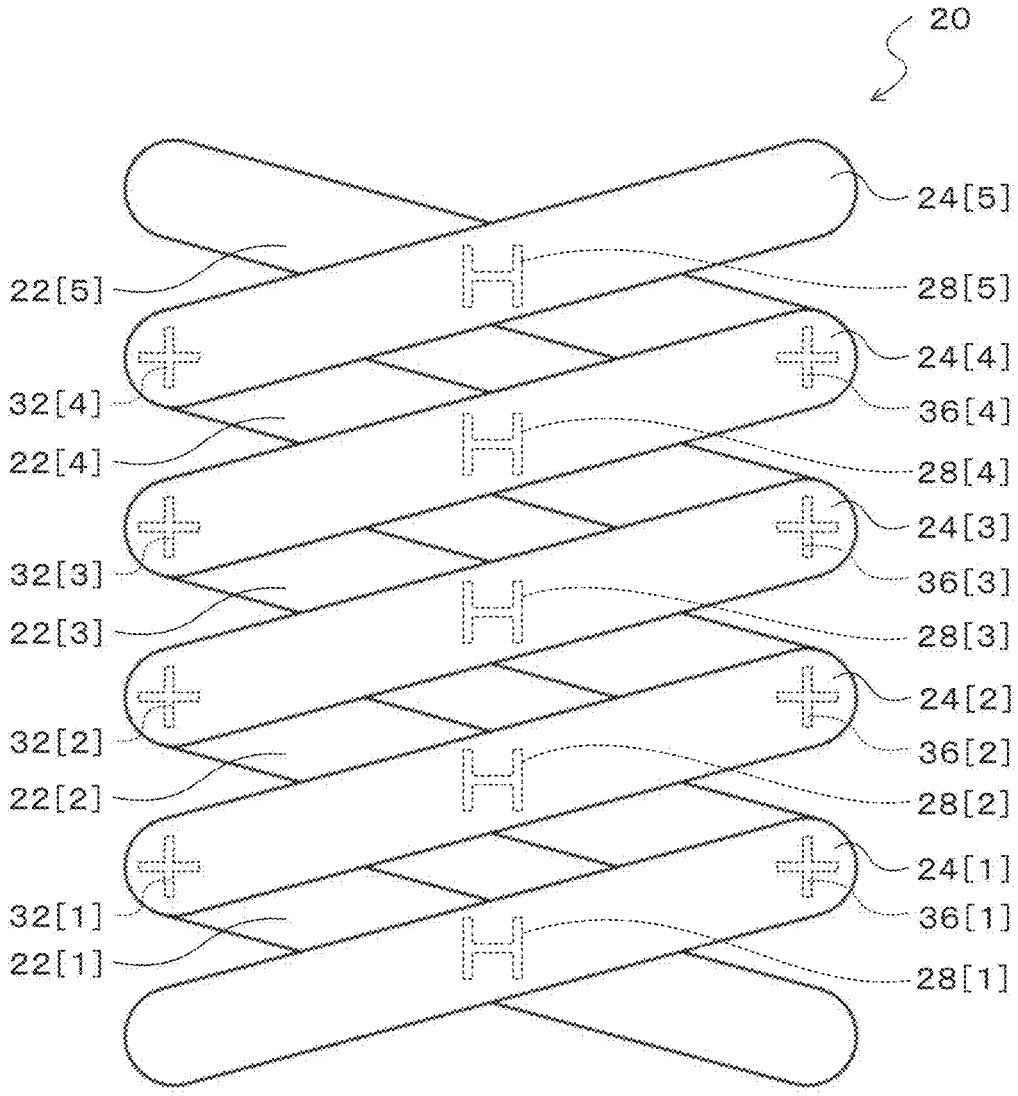
FIG. 11 is a top view of a scissors structure 20 as a modification of the first embodiment of the present disclosure.

In the scissors structure 20 of the first embodiment, each of the connecting members 28, 30, 32, 34, 36 and 38 is cross-shaped in cross section. However, each of the connecting members 28, 30, 32, 34, 36 and 38 may have the lower torsional stiffness relative to the axial and bending stiffness. For example, each of the connecting members 28, 30, 32, 34, 36 and 38 may be H-shaped in cross section. Some of the connecting members 28, 30, 32, 34, 36 and 38 may be cross-shaped in cross section and the remaining of them may be H-shaped in cross section, as shown in a modification of the first embodiment in FIG. 11. In this case, for example, each of the connecting members 28 and 30 may be cross-shaped in cross section and each of the connecting members 32, 34, 36 and 38 may be H-shaped in cross section. The scissors structure 20B may be considered in the same manner.

The scissors structure 20 of the first embodiment includes the five arm members 22, 24 and 26, respectively, the five connecting members 28 and 30 respectively, and the four connecting members 32, 34, 36 and 38 respectively. However, the numbers of the arm members 22, 24 and 26 and the connecting members 28, 30, 32, 34, 36 and 38 are not limited to this, and the scissors structure may include N1 (N1≥2) arm members 22, 24 and 26, N1 connecting members 28 and 30, and (N1−1) connecting members 32, 34, 36 and 38. The scissors structure 20B may be considered in the same manner.

The scissors structure 20 of the first embodiment includes the five arm members 22, the five arm members 24, the five connecting members 28, the four connecting members 32, and the four connecting members 36. However, the scissors structure may include only one arm member 22, one arm member 24, and one connecting member 28. That is, the one arm member 22, the one arm member 24, and the one connecting member 28 of the scissors structure may be integrally molded.

Embodiment 2

Figure 6:
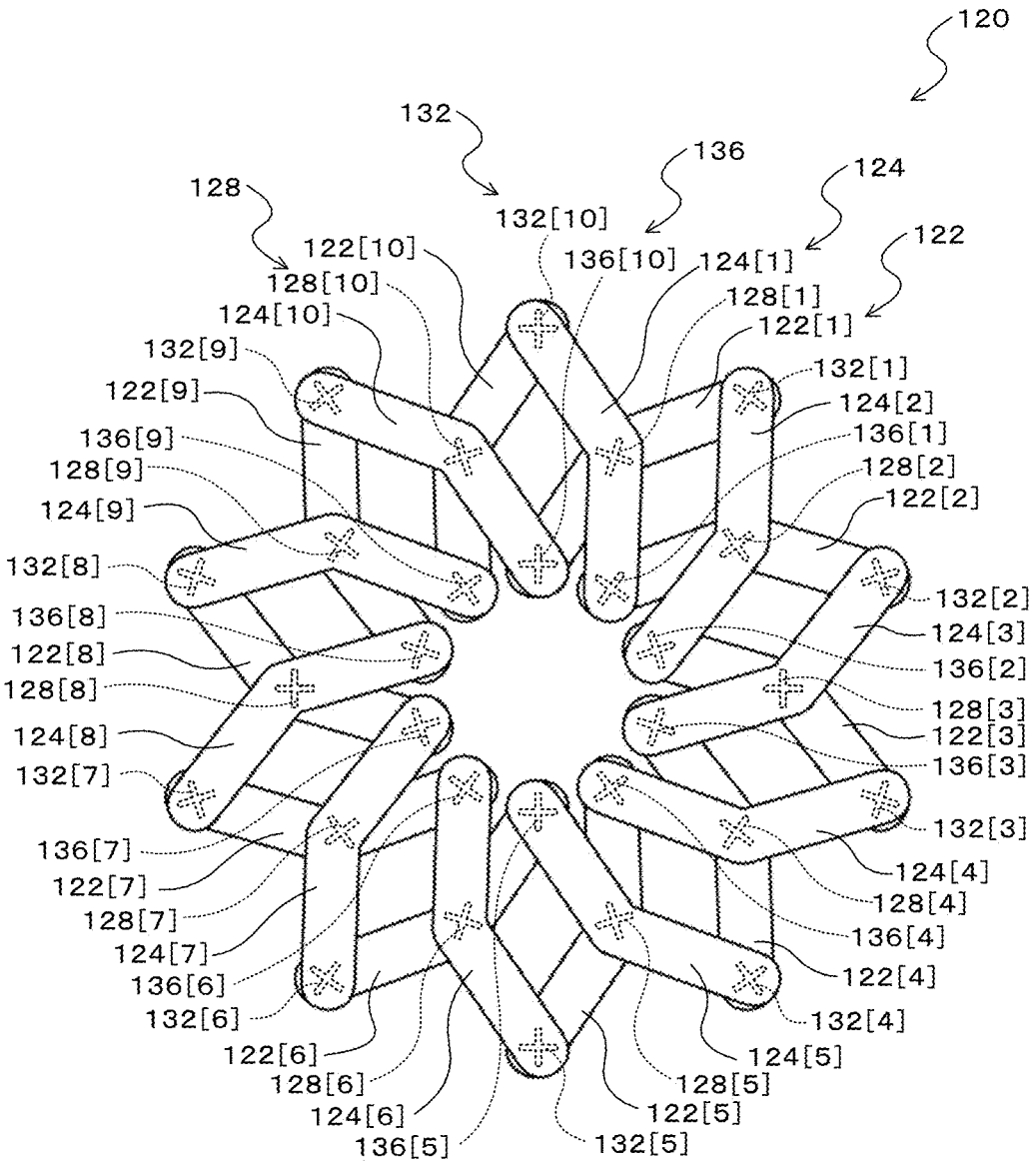
FIG. 6 is a top view of a scissors structure 120 as a second embodiment of the present disclosure.
Figure 7:
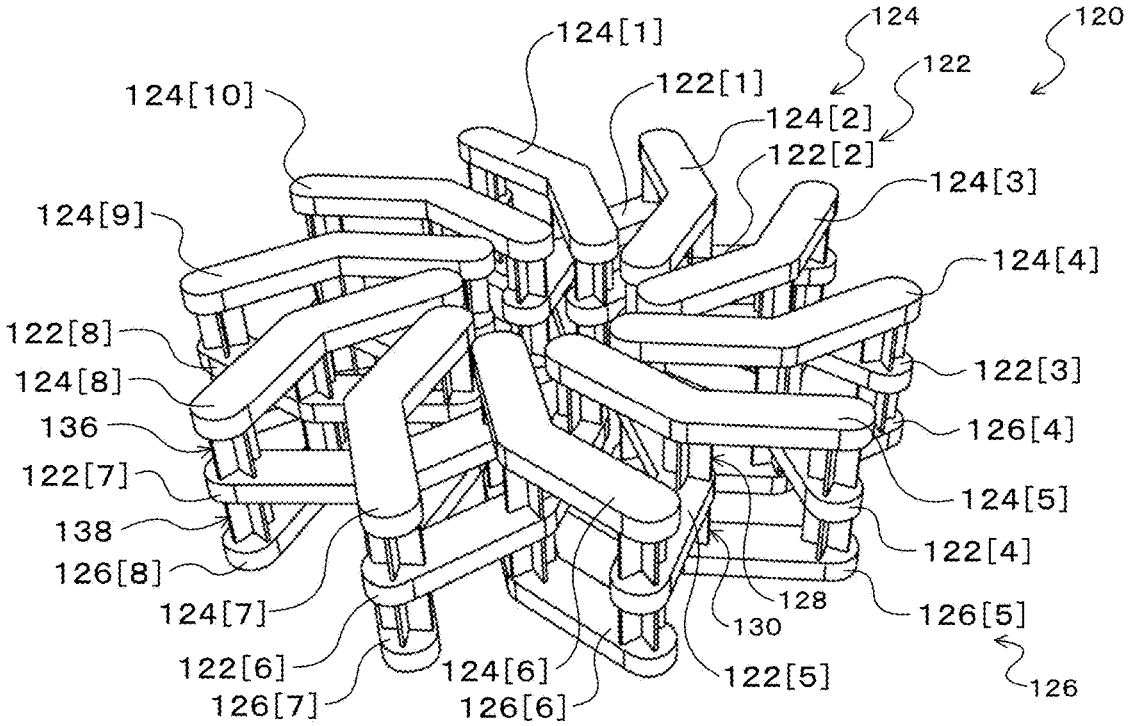
FIG. 7 is a perspective view of the scissors structure 120.
Figure 8:
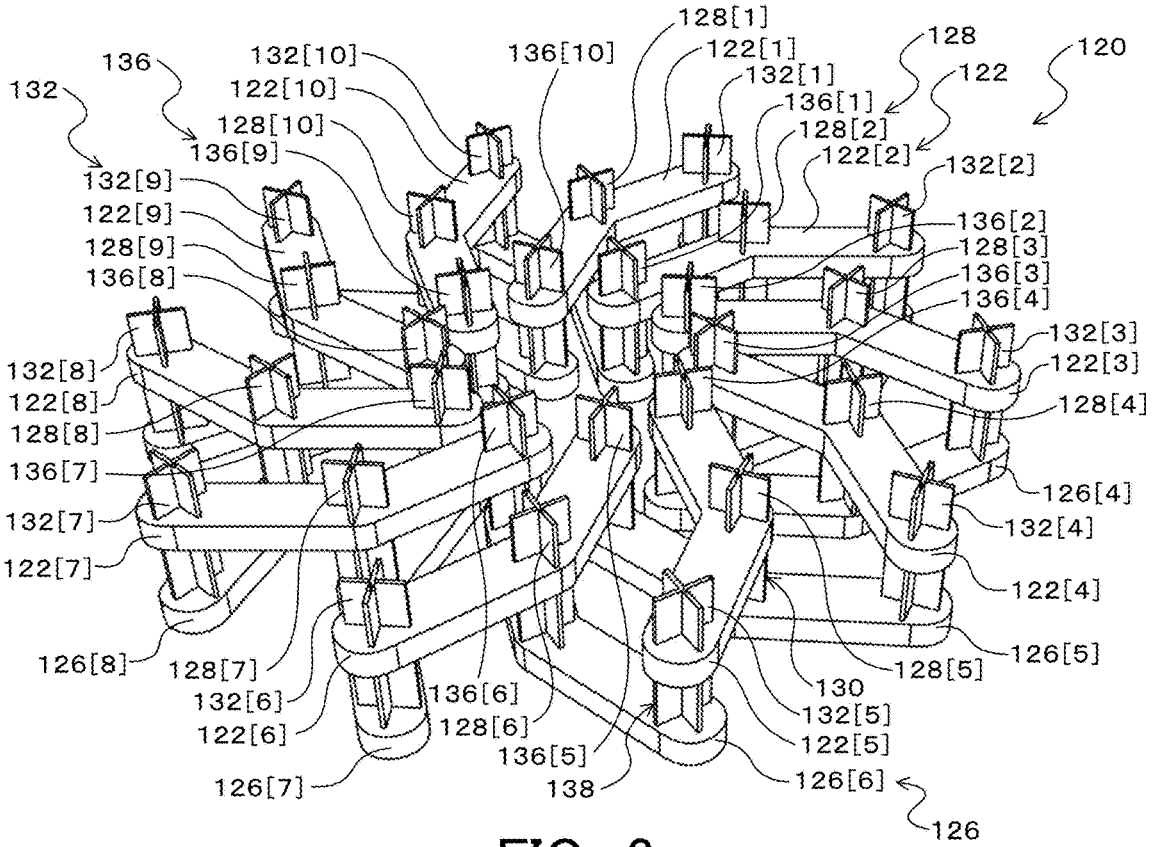
FIG. 8 is a diagram in which an arm member 124 is omitted from FIG. 7.
Figure 9:
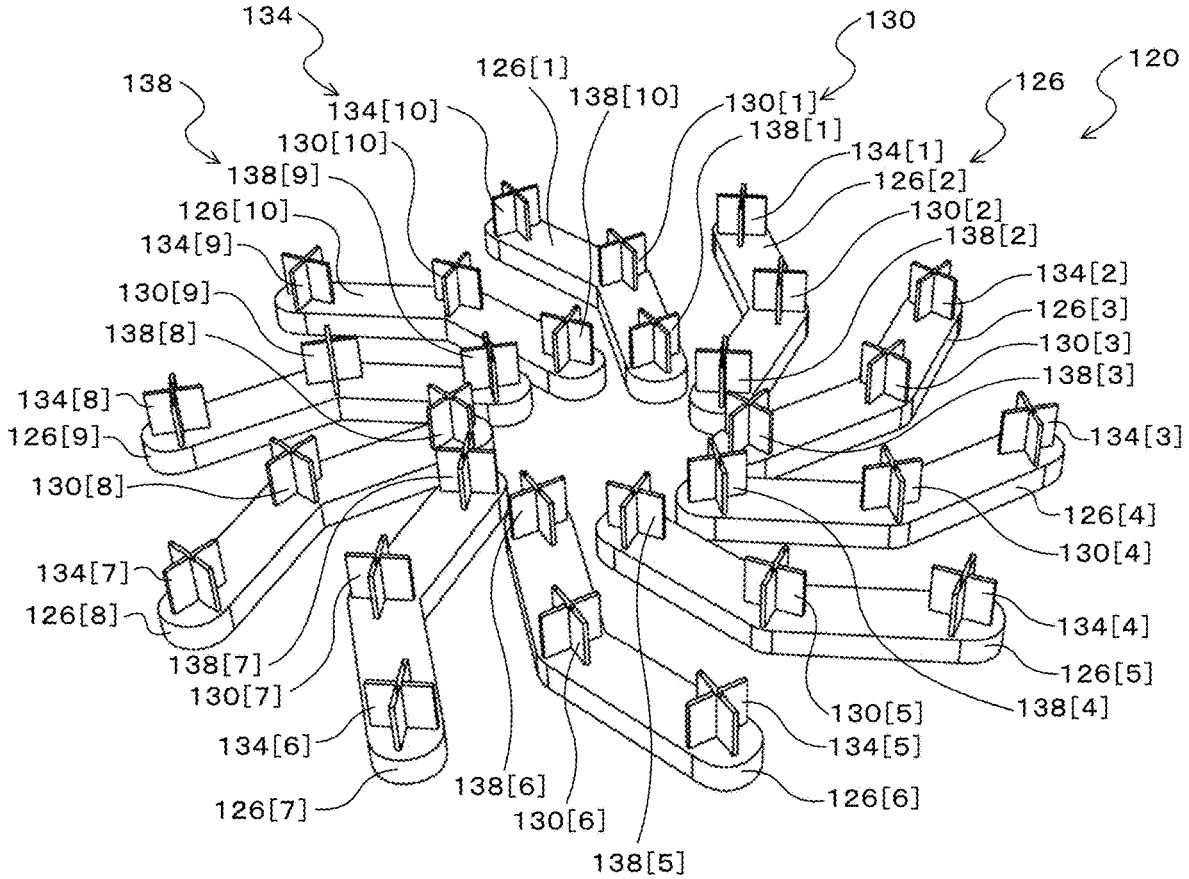
FIG. 9 is a diagram in which an arm member 122 and connecting members 128, 132 and 136 are omitted from FIG. 8.

FIG. 6 is a top view of a scissors structure 120 as a second embodiment of the present disclosure. FIG. 7 is a perspective view of the scissors structure 120. FIG. 8 is a diagram in which an arm member 124 is omitted from FIG. 7. FIG. 9 is a diagram in which an arm member 122 and connecting members 128, 132 and 136 are omitted from FIG. 8. The scissors structure 20 of the second embodiment is configured as an integrally molded member, integrally molded by the same manufacturing method as the scissors structure 20 of the first embodiment.

As shown in FIGS. 6 to 9, the scissors structure 120 includes ten arm members 122 (122[1] to 122[10]), 124 (124[1] to 124[10]) and 126 (126[1] to 126[10]), respectively, ten connecting members 128 (128[1] to 128[10]), 130 (130[1] to 130[10]), (132[1] to 132[10]), 134 (134[1] to 134[10]), 136 (136[1] to 136[10]) and 138 (138[1] to 138[10]), respectively. The numbers in [ ] are attached in clockwise order in FIG. 7 to FIG. 9.

The ten arm members 122[1] to 122[10] are each formed to extend in an L-shape and are arranged at intervals in a first row (a row in the center in the upward-downward direction in FIG. 7 and FIG. 8 and in circumferential direction). The ten arm members 124[1] to 124[10] are each formed to extend in an L-shape and are arranged at intervals in a second row (a row above the first row in the upward-downward direction in FIG. 7 and in the circumferential direction). The ten arm members 126[1] to 126[10] are each formed to extend in an L-shape and are arranged at intervals in a third row (a row lower than the first row in the upward-downward direction in FIG. 7 to FIG. 9 and in the circumferential direction). In the following, for the arm members 122[1] to 122[10], 124[1] to 124[10], and 126[1] to 126[10], the outer edge in FIG. 7 to FIG. 9 is referred to as "one end", and the inner edge in FIG. 7 to FIG. 9 as "the other end".

Each arm member 124[*i*] (i: 1 to 10) and each arm member 126[*i*] overlap each other in the upward-downward direction in FIG. 7. Each arm member 122[*i*] and each of the arm members 124[*i*] and 126[*i*] intersect each other in an X-shape in the upward-downward direction in FIG. 7. One end of each arm member 122[*i*] (i: 1 to 10) and one end of each of the arm members 124[*j*] (j: i+1 (when i≤9) or 1 (when i=10)) and 126[*j*] overlap each other in the upward-downward direction in FIG. 7. The other end of each of the arm members 124[*i*] (i: 1-10) and 126[*i*] and the other end of each arm member 122[*j*] (j: i+1 (when i≤9) or 1 (when i=10)) overlap each other in the upward-downward direction in FIG. 7.

Each connecting member 128[*i*] (i: 1 to 10) connects a central portion in the extending direction of the corresponding arm member 122[*i*] and the central portion in the extending direction of the corresponding arm member 124[*i*], and is cross-shaped in cross section and extends in a straight line, respectively. Each connecting member 130[*i*] connects a central portion in the extending direction of the corresponding arm member 122[*i*] and a central portion in the extending direction of the corresponding arm member 126[*i*], and is cross-shaped in cross-section and extends in a straight line, respectively. Each connecting member 130[*i*] extends along the same axis as the corresponding connecting member 128[*i*], respectively.

Each connecting member 132[*i*] (i: 1 to 10) connects one end of the corresponding arm member 122[*i*] and one end of the corresponding arm member 24[*j*] (j: i+1 (when i≤9) or 1 (when i=10)), and is cross-shaped in cross section and extends in a straight line, respectively. Each connecting member 134[*i*] connects one end of the corresponding arm member 122[*i*] and one end of the corresponding arm member 126[*j*], and is cross-shaped in cross section and extends in a straight line, respectively. Each connecting member 134[*i*] extends along the same axis as the corresponding connecting member 132[*i*], respectively.

Each connecting member 136[*i*] (i: 1 to 10) connects the other end of the corresponding arm member 124[*i*] and the other end of the corresponding arm member 122[*j*] (j: i+1 (when i≤9) or 1 (when i=10)), and is cross-shaped in cross section and extends in a straight line, respectively.

Each connecting member 138[*i*] connects the other end of the corresponding arm member 126[*i*] and the other end of the corresponding arm member 122[*j*], and is cross-shaped in cross-section and extends in a straight line, respectively. Each connecting member 138[*i*] extends along the same axis as the corresponding connecting member 136[*i*].

Figure 10A:
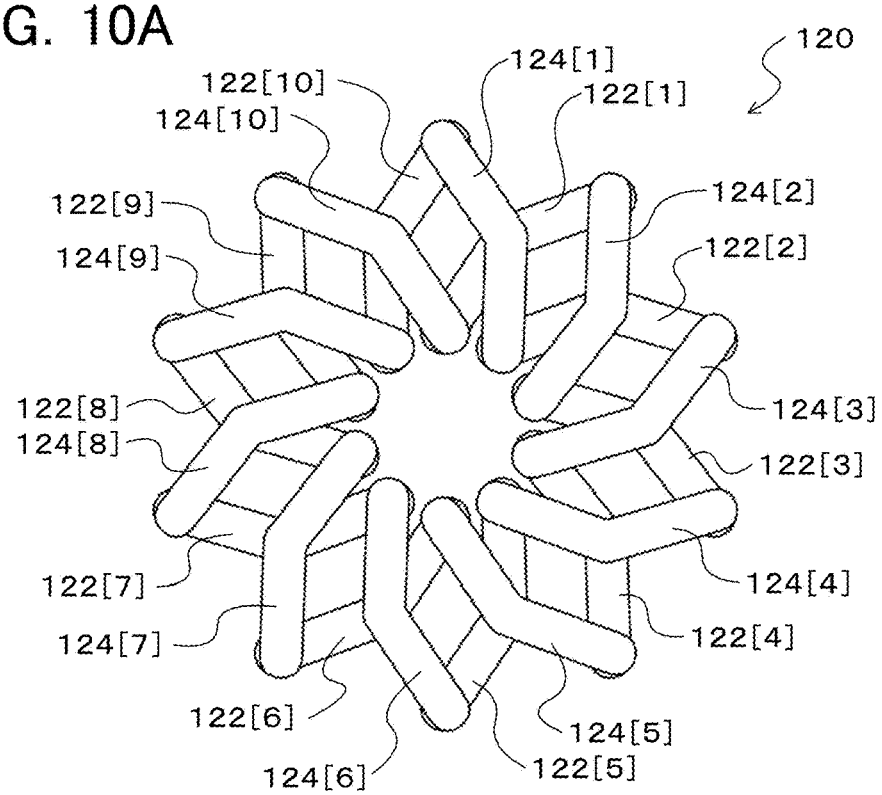
FIG. 10A is an illustration of deformation of the scissors structure 120.
Figure 10B:
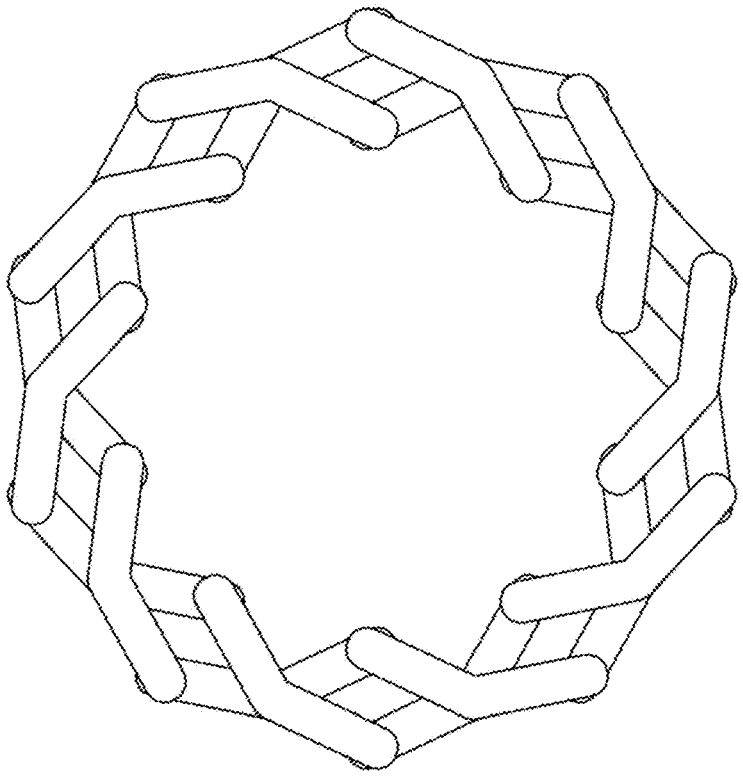
FIG. 10B is an illustration of deformation of the scissors structure 120.

In the second embodiment, the scissors structure 120 is integrally molded in the same manner as the scissors structure 20 of the first embodiment, and the cross section of each of the connecting members 128, 130, 132, 134, 136 and 138 is cross-shaped. Therefore, each of the connecting members 128, 130, 132, 134, 136 and 138 has low torsional stiffness relative to axial and bending stiffness, and has compliant mechanism characteristics which is easily deformed in the torsional direction and prevent deformation in other directions such as compression, tension and bending. Thus, the two corresponding arm members connected by each connecting member (e.g., the arm member 122[1] and the arm member 124[1] connected by the connecting member 128[1]) are easily (to somewhat large and stable extent) rotated around the connecting members. This enables a somewhat large deformation (change in diameter) of the scissors structure 120 to be stably produced by applying a force to the scissors structure 120 to increase its diameter. FIG. 10 is an illustration of deformation of the scissors structure 120. By applying a force to the scissors structure 120 in the initial state of FIG. 10A to increase its diameter, the diameter of the entire scissors structure 120 is increased as shown in FIG. 10B.

In the scissors structure 120 of the second embodiment described above, the arm members 122 (122[1] to 122[10]), 124 (124[1] to 124[10]) and 126 (126[1] to 126[10]) and the connecting members 128 (128[1] to 128[10]), 130 (130[1] to 130[10]), 132 (132[1] to 132[10]), 134 (134[1] to 134[10]), 136 (136[1] to 136[10]) and 138 (138[1] to 38[10]) are integrally molded, and each of the connecting members 128, 130, 132, 134, 136 and 138 is cross-shaped in cross-section. This enables a reduction in the number of components. In addition, this enables a somewhat large deformation (change in diameter) of the scissors structure 20 to be stably produced, because each of the connecting members 128, 130, 132, 134, 136 and 138 has the low torsional stiffness relative to the axial and bending stiffness. Furthermore, the scissors structure 120 of this embodiment has no gap between each component, unlike the configuration in which the arms and screws are assembled as in the above-mentioned background technology (see Patent Document 1). Therefore, the scissors structure 120 performs deformation operation more accurately because there is no so-called rattling or asymmetry that may occur due to such gaps during the deformation operation.

The scissors structure 120 of the second embodiment includes the arm members 122, 124 and 126 and the connecting members 128, 130, 132, 134, 136 and 138. However, the configuration may be without the arm member 126 and the connecting members 130, 134 and 138 of the scissors structure 120 (hereinafter referred to as "scissors structure 120B"). The scissors structure 120B enables somewhat large deformation (change in diameter) to be stably produced in the same manner as the scissors structure 120. It is assumed that the scissors structure 120B has the lower bending stiffness of the entire structure than the scissors structure 120, and is more likely to undergo a deformation other than the desired deformation.

In the scissors structure 120 of the second embodiment, each of the connecting members 128, 130, 132, 134, 136 and 138 is cross-shaped in cross section. However, each of the connecting members 128, 130, 132, 134, 136 and 138 may have the lower torsional stiffness relative to the axial and bending stiffness. For example, each of the connecting members 128, 130, 132, 134, 136 and 138 may be H-shaped in cross section. Some of the connecting members 128, 130, 132, 134, 136 and 138 may be cross-shaped in cross section and the remaining of them may be H-shaped in cross section. In this case, for example, each of the connecting members 128 and 130 may be cross-shaped in cross section and each of the connecting members 132, 134, 136 and 138 may be H-shaped in cross section. The scissors structure 120B may be considered in the same manner.

The scissors structure 120 of the second embodiment includes the ten arm members 122, 124 and 126, respectively, the ten connecting members 128, 130, 132, 134, 136 and 138 respectively. However, the numbers of the arm members 122, 124 and 126 and the connecting members 128, 130, 132, 134, 136 and 138 are not limited to this, and the scissors structure may include N2 arm members 122, 124 and 126 and N2 connecting members 128, 130, 132, 134, 136 and 138. The scissors structure 20B may be considered in the same manner.

The scissors structure 120 of the second embodiment includes the ten arm members 122, the ten arm members 124, the ten connecting members 128, the ten connecting members 132, and the ten connecting members 136. However, the scissors structure may include only one arm member 122, one arm member 124, and one connecting member 128. That is, the one arm member 122, the one arm member 124, and the one connecting member 128 of the scissors structure may be integrally molded.

The following describes the correspondence relationship between the primary elements of the above embodiment and the primary elements of the disclosure described in Summary. In the first embodiment, the arm member 22[*i*] corresponds to the "first arm member", the arm member 24[*i*] corresponds to the "second arm member", and the connecting member 28[*i*] corresponds to the "first connecting member". In the second embodiment, the arm member 122[*i*] corresponds to the "first arm member", the arm member 124[*i*] corresponds to the "second arm member", and the connecting member 128[*i*] corresponds to the "first connecting member".

The correspondence relationship between the primary components of the embodiment and the primary components of the disclosure, regarding which the problem is described in Summary, should not be considered to limit the components of the disclosure, regarding which the problem is described in Summary, since the embodiment is only illustrative to specifically describes the aspects of the disclosure, regarding which the problem is described in Summary. In other words, the disclosure, regarding which the problem is described in Summary, should be interpreted on the basis of the description in the Summary, and the embodiment is only a specific example of the disclosure, regarding which the problem is described in Summary.

The aspect of the disclosure is described above with reference to the embodiment. The disclosure is, however, not limited to the above embodiment but various modifications and variations may be made to the embodiment without departing from the scope of the disclosure.

Additional Notes

A scissors structure includes a first arm member, a second arm member, and a first connecting member connecting a central portion of the first arm member and a central portion of the second arm member. The first and second arm members and the first connecting member are integrally molded, and the first connecting member is formed such that its torsional stiffness is low relative to its axial and bending stiffness.

In the scissors structure of the present disclosure, the first and second arm members and the first connecting member are integrally molded, and the first connecting member is formed such that its torsional stiffness is low relative to its axial and bending stiffness. Thus, the first and second arm members are easily (to somewhat large and stable) rotated around the first connecting member. As a result, this enables a somewhat large deformation (change in length in the longitudinal direction) of the scissors structure to be stably produced.

In the scissors structure of the present disclosure, the first connecting member may be cross-shaped or H-shaped in cross section. In this way, this enables the torsional stiffness to be low relative to the axial and bending stiffness, in the first connecting member.

In the scissors structure of the present disclosure, the scissors structure may include the first arm member and a third arm member arranged in a first row, the second arm member and a fourth arm member arranged in a second row, the first connecting member connecting the central portion of the first arm member and the central portion of the second arm member, a second connecting member connecting a central portion of the third arm member and a central portion of the fourth arm member, a third connecting member connecting one end of the first arm member and one end of the fourth arm member, and a fourth connecting member connecting one end of the third arm member and one end of the second arm member. The first, second, third and fourth arm members and the first, second, third and fourth connecting members may be integrally molded, and the first, second, third and fourth connecting members may be formed such that their torsional stiffness may be low relative to their axial and bending stiffness. Thus, the first, second, third and fourth arm members are easily (to somewhat large and stable) rotated around the corresponding connecting member. As a result, this enables a somewhat large deformation (change in length in the longitudinal direction) of the scissors structure to be stably produced.

In this case, the scissors structure may further include fifth and sixth arm members arranged in a third row opposite the second and fourth arm members with respect to the first and third arm members, a fifth connecting member connecting the central portion of the first arm member and a central portion of the fifth arm member, a sixth connecting member connecting the central portion of the third arm member and a central portion of the sixth arm member, a seventh connecting member connecting one end of the first arm member and one end of the sixth arm member, and an eighth connecting member connecting one end of the third arm member and one end of the fifth arm member. The first, second, third, fourth, fifth and sixth arm members and the first, second, third, fourth, fifth, sixth, seventh and eighth connecting members may be integrally molded, and the first, second, third, fourth, fifth, sixth, seventh and eighth connecting members may be formed such that their torsional stiffness is low relative to their axial and bending stiffness. This enables the higher bending stiffness (stiffness against deformation other than the desired deformation) of the entire scissors structure.

The invention claimed is:

1. A scissors structure comprising:

a first arm member;

a second arm member; and a first connecting member connecting a central portion of the first arm member and a central portion of the second arm member, wherein the first and second arm members and the first connecting member are integrally molded, and the first connecting member is formed such that its torsional stiffness is low relative to its axial and bending stiffness.

2. The scissors structure according to claim 1, wherein the first connecting member is cross-shaped or H-shaped in cross section.

3. The scissors structure according to claim 1, further comprising:

a third arm member arranged in a first row with the first arm member;

a fourth arm member arranged in a second row with the second arm member;

a second connecting member connecting a central portion of the third arm member and a central portion of the fourth arm member;

a third connecting member connecting one end of the first arm member and one end of the fourth arm member; and a fourth connecting member connecting one end of the third arm member and one end of the second arm member, wherein the first, second, third and fourth arm members and the first, second, third and fourth connecting members are integrally molded, and the first, second, third and fourth connecting members are formed such that their torsional stiffness is low relative to their axial and bending stiffness.

4. The scissors structure according to claim 3, further comprising:

a fifth and a sixth arm members arranged in a third row opposite the second and fourth arm members with respect to the first and third arm members;

a fifth connecting member connecting the central portion of the first arm member and a central portion of the fifth arm member;

a sixth connecting member connecting the central portion of the third arm member and a central portion of the sixth arm member;

a seventh connecting member connecting one end of the first arm member and one end of the sixth arm member; and an eighth connecting member connecting one end of the third arm member and one end of the fifth arm member, wherein the first, second, third, fourth, fifth and sixth arm members and the first, second, third, fourth, fifth, sixth, seventh and eighth connecting members are integrally molded, and the first, second, third, fourth, fifth, sixth, seventh and eighth connecting members are formed such that their torsional stiffness is low relative to their axial and bending stiffness.

* * * * *